US005862526A

United States Patent [19]

Longcor et al.

[11] Patent Number: 5,862,526

[45] Date of Patent: Jan. 26, 1999

[54] EXPANDABLE AND COLLAPSIBLE BELT-STRAP CARD HOLDER

[76] Inventors: Keenan Longcor, 9314 NE. Sacramento, Portland, Oreg. 97220; Marc Hayman, 14 Laurel Ave., Belvedere, Calif. 94920

[21] Appl. No.: 95,295

[22] Filed: Jul. 21, 1993

Related U.S. Application Data

[63] Continuation-in-part of Ser. No. 973,306, Nov. 9, 1992, abandoned.

[51] Int. Cl.[6] ..... A41D 27/20

[52] U.S. Cl. ..... 2/338; 2/247; 2/252; 2/253; 2/312; 224/224; 224/228; 224/901

[58] Field of Search ..... 2/300, 310, 311, 2/319, 338, DIG. 11, 247, 248, 249, 250, 251, 252, 253, 254; 150/107, 106, 118, 119, 127, 134, 150; 224/197, 199, 202, 203, 205, 206, 224, 228, 226, 235, 236, 250, 901; 383/86, 120

[56] References Cited

U.S. PATENT DOCUMENTS

| | | | |
|---|---|---|---|
| 1,382,446 | 6/1921 | Warren | 2/311 |
| 2,337,961 | 12/1943 | Arnold | 150/42 |
| 2,798,524 | 7/1957 | Ryon | 150/28 |
| 4,415,106 | 11/1983 | Connell et al. | 224/221 |
| 4,492,313 | 1/1985 | Touzani | 215/1 C |
| 4,722,464 | 2/1988 | Wright | 224/224 |

FOREIGN PATENT DOCUMENTS

| | | | |
|---|---|---|---|
| 624295 | 7/1981 | Switzerland . | |
| 0446742 | 5/1936 | United Kingdom | 150/118 |

OTHER PUBLICATIONS

Gershman, Maurice, "Self Adhering Nylon Tapes." The J.A.M.A, vol. 168, No. 7, Oct. 1958.

*Primary Examiner*—Jeanette E. Chapman
*Attorney, Agent, or Firm*—David Pressman

[57] ABSTRACT

An expandable and collapsible belt-strap container for conveniently carrying sports cards on a person comprises a container (10) having an inner side attached to the mid-portion (14) of a belt (12) by elastic webbings (13 and 13'). The container comprises an expandable and collapsible bellows (11) with an open top, and a flap (18) hingeably attached to an outer side of the container. The flap stretches across the open top and down the inner side of the bellows. A long piece of hook-and-loop fastener (19) is attached to the inner side of the bellows, while a short piece of hook-and-loop fastener (20) is attached to the distal side of the flap. Therefore, when the bellows is fully collapsed, the distal side of the flap may be attached to the lower side of the long fastener. When the bellows is fully expanded for carrying a large number of sports cards, the side of the flap may be attached to the upper side of the long fastener. Because the flap is attached to the bottom of the inner side of the container, it will stay in an opened position when swung outwardly. The bellows comprises a plurality of pleats, each having long and short sections, and sides and a bottom which are attached by curved comers, such that each pleat will be bistable (expanded or collapsed). The container, covering flap, and belt can all be separated or attached together.

16 Claims, 7 Drawing Sheets

EXPANDABLE AND COLLAPSIBLE BELT-STRAP CARD HOLDER

BACKGROUND-CROSS-REFERENCE TO RELATED APPLICATION

This patent is based upon an application which is a Continuation-In-Part of application Ser. No. 07/973,306, Filed Nov. 9, 1992 now abandoned. This CIP application was filed to add the embodiments of FIGS. 6 and 7.

1. Background-Field of Invention

This invention relates generally to devices for carrying small items on a person, specifically to a belt-strap card holder.

2. Background-Prior Art

Cards showing pictures of players in baseball, football, and other sports are popular and are actively traded nowadays. Hobbyists and professional baseball card traders often attend card conventions, card shows, schools, stores, etc. and carry a great number of cards on their persons. Presently, they carry thick stacks of cards unprotected in their hands, in pockets on their clothing, in rigid (usually plastic, opaque, or clear) boxes, cloth pouches, or large notebooks with thin, vinyl pockets. These methods either expose the cards to potential damage, which can substantially reduce their value, or are so large and cumbersome such that carrying them around a convention can be very inconvenient and tiring.

Various strap-on containers are U.S. Patent D-293,387 to Wagner (1987) shows a knapsack belt with an attached large container covered with a flap. The mid-portion of the belt flares out to the height of the container for a cosmetically appealing transition. Although it could be used for carrying cards, the capacity of this container is fixed, such that it can carry only a small number of cards. Furthermore, the flap is hinged on the inner end of the container, so that the user must use one hand to hold the flap open, which leaves only one other hand for accessing the contents of the container.

U.S. Patent D-104,572 to Lewis (1937) shows a sports belt having containers with two thin, bellows-shaped, expandable compartments covered by a flap with a snap fastener at a fixed location. If the compartments are filled to capacity with tall cards, such that the bellows is fully extended, the distance between the snap on the container and the snap on the flap will exceed the length of the flap. As a result the flap cannot be snapped close. Moreover, the bellows will tend to stay expanded after prolonged use, which makes the container cumbersome to carry.

U.S. Pat. No. 2,576,474 to Nash (1949) shows a single-pleated bellows container with a spring for expansion. The spring can be impractical for a container with many pleats because many springs would have to be used. In addition, the capacity of this container is also constrained by a fixed snap fastener.

U.S. Pat. No. 1,82,446 to Warren (1921) shows a garter with a flat purse attached thereto. However this container is too flat to hold many cards, and any cards therein cannot be easily accessed since this container has a flap which must be held open with one hand.

Connell and Swanson, in U.S. Pat. No. 4,415,106 (1983) shows a map holder Again this compartment is suitable for holding only one sheet and can't be easily accessed.

Worrall, in U.K. patent 446,742 (1936) shows a bellows case with a closure flap.

However this case must be carried by hand and its bellows and flap will not stay open of their own so that accessing the contents is difficult and requires two hands.

In conclusion, existing belt-strap containers do not protect their contents from damage, and they either cannot vary their capacities to suit the volume of their contents, or their flaps cannot be dosed if they are filled to maximum capacity. Their bellows can become fatigued after prolonged use so that they will stay expanded. In addition, the user must hold the flaps open and out of the way to view and access the contents.

OBJECTS AND ADVANTAGES

Accordingly, several objects and advantages of the invention are to provide an expandable and collapsible belt-strap container which may be expanded and collapsed to suit the volume of its contents, which maintains any desired volume from collapsed to fully open, even when empty, which has a flap which can be closed regardless of the volume of the contents, which has a flap which automatically stays open for improving access to the container, which may be conveniently and effortlessly carried on a person, which may be leveled whether the belt-strap is worn on the waist or the shoulder, which has a snap-closing flap, which protects its contents, which can be detached easily from its strap carrier, with or without its belt, and which is simple and economical to manufacture.

Further objects and advantages will become apparent from a study of the following description and the accompanying drawings.

DRAWING FIGURES

Drawing Reference Numerals

| | | | |
|---|---|---|---|
| 10. | container | 10f | front side |
| 10b. | back side | 11. | bellows |
| 12. | belt or strap | 13. | elastic webbing |
| 14 | mid-section of belt | 15 | buckle |
| 16 | latch | 17 | flap |
| 18 | flap end | 19 | long fastener |
| 20 | short fastener | 21 | adhesive |
| 22 | belt | 23 | elastic webbing |
| 25 | pivot | 26 | washer |
| 27 | medium fastener | 28 | person |
| 30 | female half of snap | 32 | male half of snap |
| 34 | male-female snap | | |

Description

FIG. 1

Container On Belt

Figure 1:
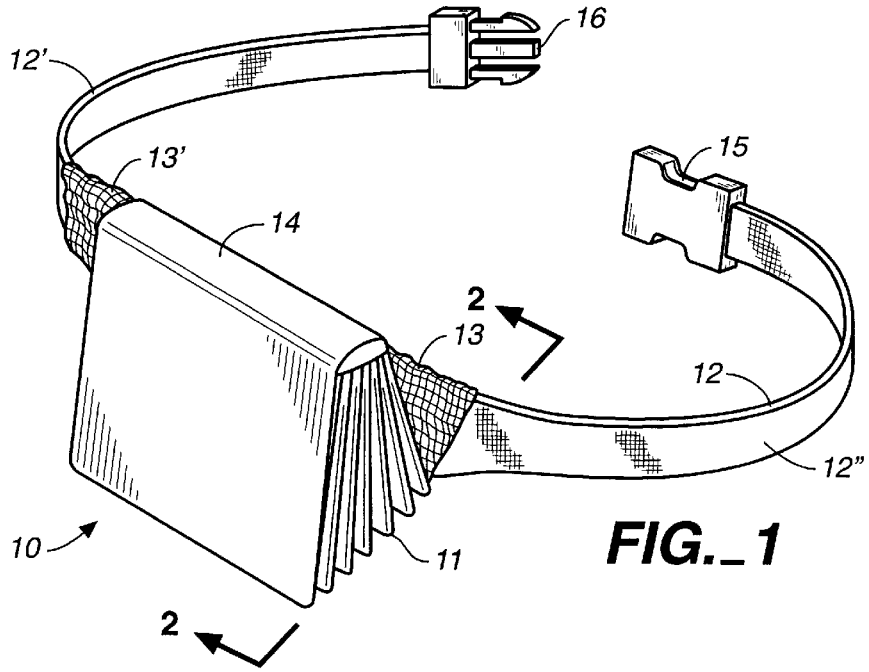
FIG. 1 is a perspective view of an expandable and collapsible belt-strap container in accordance with a preferred embodiment of the invention in which a closure flap is attached to an outer side of the container.

In accordance with a preferred embodiment of the invention as shown in FIG. 1, an expandable, tiltable, and collapsible box, container, or holder for sports trading cards (baseball, football, or other ) comprises a generally rectangular container 10 of durable nylon with an expandable and collapsible plastic bellows 11.

Bellows 11, shown collapsed, comprises the pleated sides (opposite each other) and the bottom of the container. The container also has a back or inner side 10B (best shown in FIGS. 2A and B; not shown in but most distant from the observer of FIG. 1). Back side 10*b* is attached to the nylon mid-section 14 of a strong nylon belt or strap (hereinafter strap) 12 by triangular, elastic webbings 13 and 13'.

Strap 12 has a conventional buckle 15 and snap latch 16 and is divided into a left portion 12' and a right portion 12". Container 10 also has a front side or outer side 10E (FIGS. 1, 2A, and 2B) opposite to back side 10*b*. Bellows 11 is attached to, and interconnects front and back sides 10*f* and 10*b*. Sides 10*f* and 10*b* are made of plastic or cardboard.

Container 10 may be used to hold and protect a large number of sports cards (not shown), and may be conveniently strapped around the waist or shoulder of a person (not shown) with strap 12, such that the sports cards may be carried around a card convention or the like with ease.

Description

FIG. 2A

Container Collapsed

Cover Closed

Figure 2A:
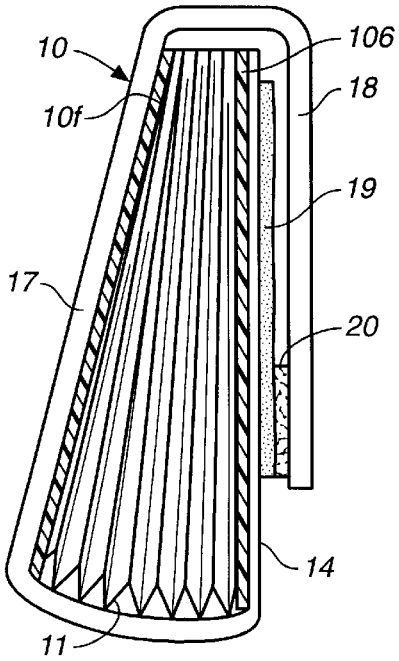
FIG. 2A is a partial sectional side view of a container similar to FIG. 1, taken along line 2—2. The container of FIG. 2A employs a flap which extends under the container and is anchored to the inner side of the container.

As shown in the partial sectional view in FIG. 2A, the inner side of container 10 is attached to nylon midportion 14 of strap 12. Container 10 has a flap or cover 17, preferably of nylon, with bottom, outer, top, and inner sides, portions, or sections. Flap 17 extends from the bottom of back side 10*b*, under the bellows, up around front side 10*f*, over the open top and down the inner side of the container so that flap end 18 of flap 17 covers most of the inner side of the container. A long strip of hook-and-loop fastener 19 spans a substantial portion of the height of container 10 and is attached to the inner side of mid-section 14 of strap 12, while a short strip of hook-and-loop fastener 20 is attached to the inside of the distal side of flap end 18. The bottom of cover or flap 17, being attached to the container, is a proximal portion. The remote or opposite inner side, to which hook-and-loop fastener 19 is attached, is a distal portion.

When container 10 is empty, its bellows 11 is completely collapsed for convenience, as shown. Flap 17 helps maintain this compact configuration since it extends around the bottom of bellows 11. It will maintain itself collapsed, as described infra. Flap 17 is wrapped maximally around the inner side of the container, so that short fastener 20 is attached to the lower side of long fastener 19. When the container of FIG. 2A is expanded, e.g., when filled with cards, flap end 18 will attach to a higher point on fastener 19 and flap 17 will reconfigure itself to accommodate the contents. Flap 17 may be sewn or glued to the bottom of back side 10*b*.

Description

FIG. 2B

Container Expanded

Cover Open

Figure 2B:
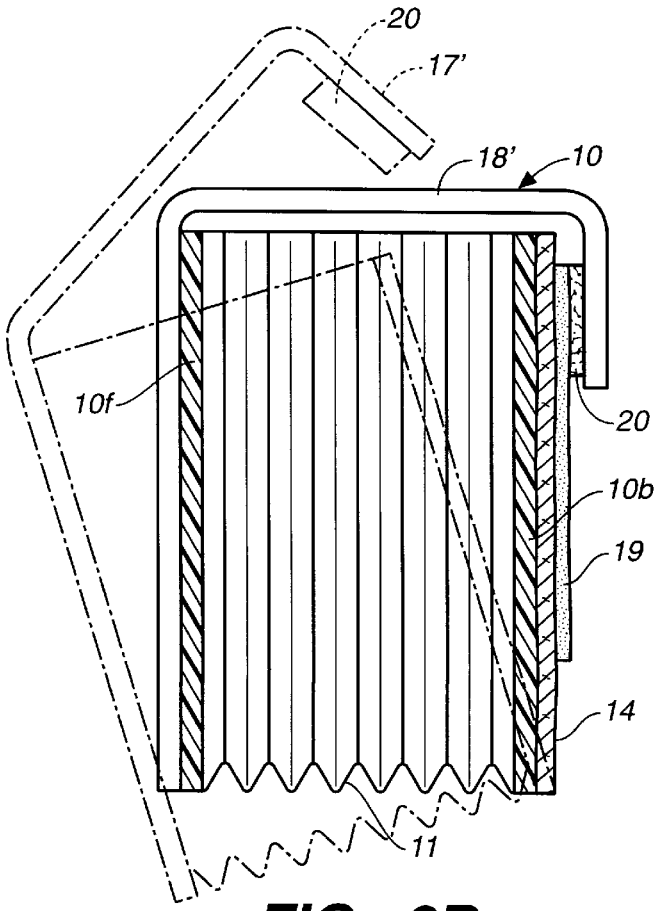
FIG. 2B is partial sectional side view of the container of FIG. 1, after being expanded and partially opened and tilted. The closure flap does not extend under the container.

In FIG. 2B, flap 17' has no bottom side; its outer side is attached to the bottom of front side 10*f*. Bellows 11 may be expanded to a great volume for holding a large number of cards (not shown). When bellows 11 is maximally expanded as shown, it will maintain itself in this position, as will be described. Most of flap 17' is stretched across the top of the bellows, such that short fastener 20 attaches flap 17' to the top side of long fastener 19.

When the card trader (not shown) wearing the container wishes to make a transaction, elastic webbings 13 (FIG. 1 ) will allow container 10 to be pivoted outwardly as shown, such that flap end 18 may be opened for access to the cards (not shown), as shown by the dashed outline of the container. Flap 17' may be swung completely over and adjacent to front side 10F. The weight of flap 17' will keep the flap open, so that the interior of bellows 11 may be conveniently accessed. Because bellows 11 has bistable pleats and rounded bottom corners, as described more fully below under FIGS. 5A, 5B, and 5C, the container will retain itself stably in a fully open position, fully dosed position, or in any position in between. Thus the cards will be openly and easily accessible, and the user can use both hands to access the cards.

Description

Figure 3A:
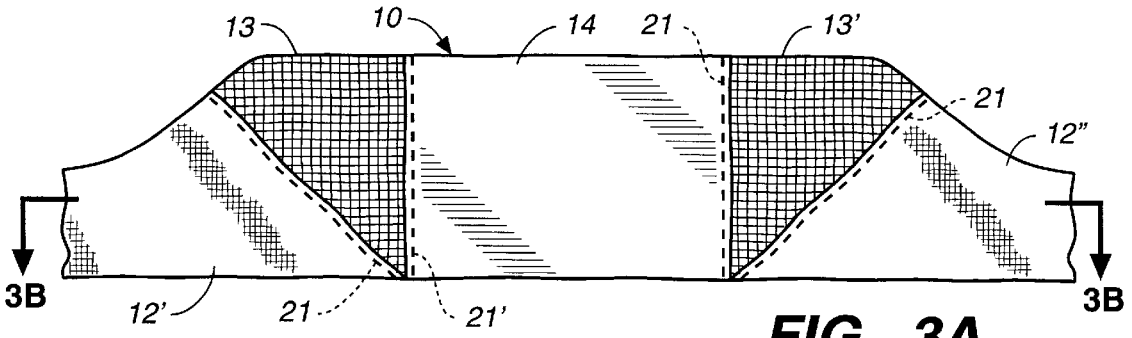
FIG. 3A is a rear view of the container of FIG. 1.
Figure 3B:
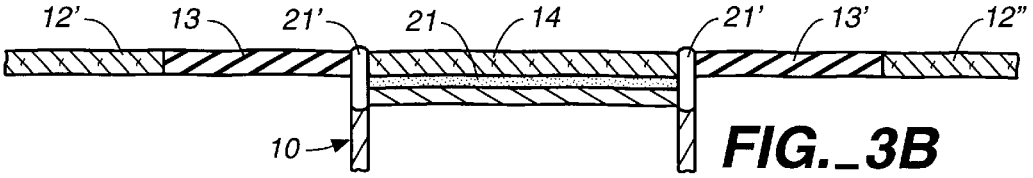
FIG. 3B is a top sectional view of the container of FIG. 3A, taken along line 3B—3B.
Figure 3C:
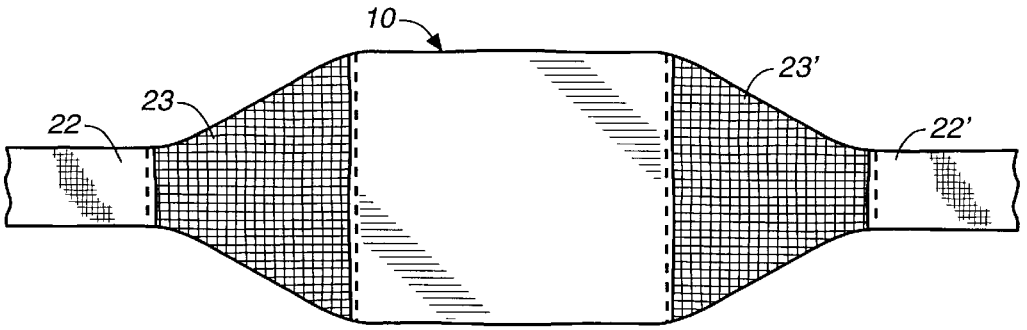
FIG. 3C is a front view of an embodiment of the container of FIG. 3A employing vertically symmetrical attachment webbings.

FIGS. 3A to 3C

Attachment To Belt

A rear view of the container is shown in FIG. 3A. Nylon midportion 14 is generally rectangular. The inner ends of strap portions 12' and 12" flare upwardly and are beveled. Generally triangular elastic webbings 13 and 13' attach the ends of strap portions 12' and 12", respectively, to the left and right sides, respectively, of midportion 14. Flap end 18 and long hook-and-loop fastener 19 are not shown for clarity. Elastic webbings 13 and 13' allow container 10 to be easily pivoted outwardly as shown in FIG. 2B. The elastic is stitched to strap 12 at 21'.

As shown in FIG. 3B, a top sectional view, bellows 11 is attached to mid-portion 14 with adhesive 21 and rows of stitching 21', while strap portions 12' and 12" are attached to mid-portion 14 by elastic webbings 13 and 13', respectively.

FIG. 3C shows a front view of an alternative embodiment of the container of FIG. 3A. Strap portions 22 and 22', which have completely parallel edges, are attached to mid-portion 14 by trapezoidal and vertically symmetrical elastic webbings 23 and 23', respectively. Thus the entire container is symmetrical along the centerline of strap portions 22 and 22'.

Description

Figure 4A:
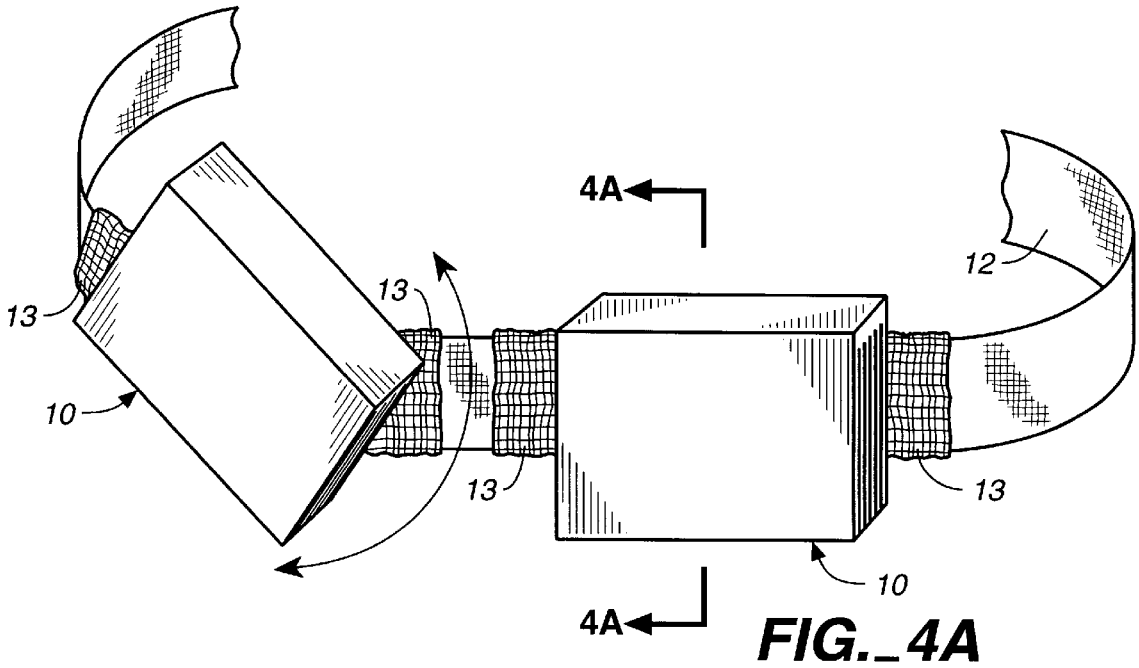
FIG. 4A is a perspective view of an embodiment the container, rotatably mounted on a belt strap.
Figure 4B:
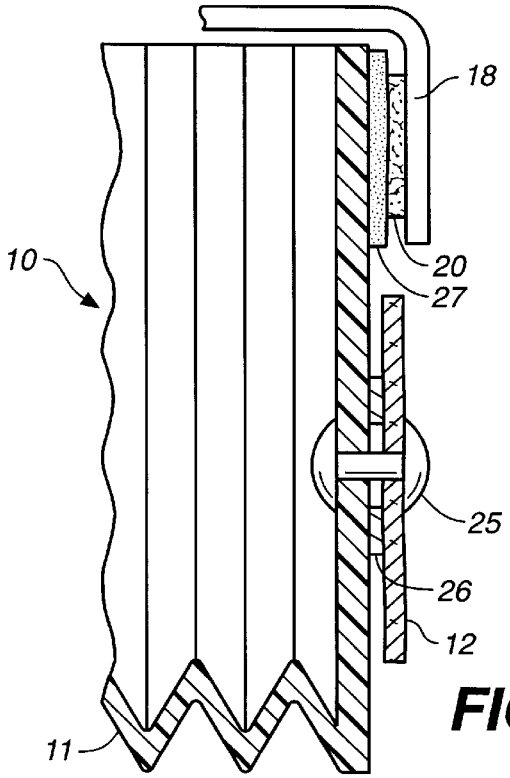
FIG. 4B is a partial sectional view of the container of FIG. 4A.
Figure 4C:
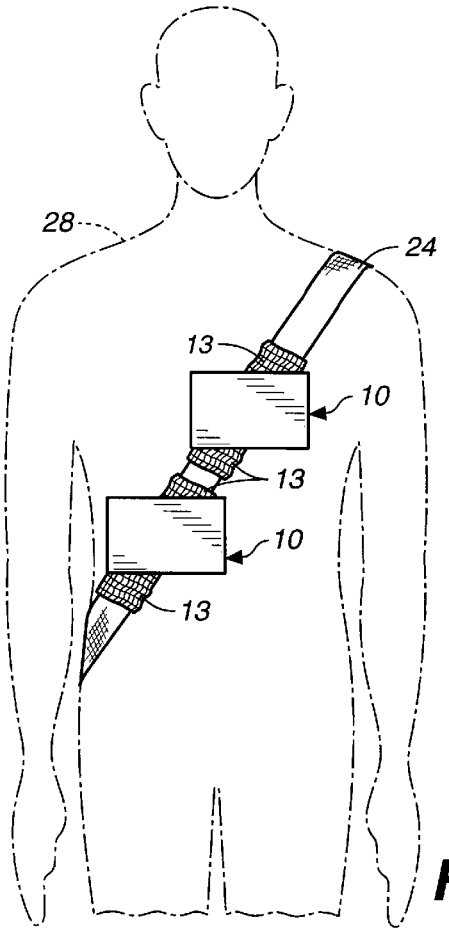
FIG. 4C is a front view of the container of FIG. 4A, as worn on a person's shoulder.

FIGS. 4A to 4C

Pivotable Containers On Strap

Two containers 10 are shown, in FIG. 4A, rotatably mounted on a conventional, nylon shoulder or waist strap 12 (partially shown). The rotational axes of containers 10 are normal to the surface of strap 12, and the containers are attached to the strap by elastic webbings 13, as before.

As shown in the partial sectional view of FIG. 4B, each container 10 (partially shown) is attached by its inner side to strap 12 with a pivot 25, such that the containers 10 may be rotated about the axis of the pivot. A washer 26 is disposed between strap 12 and the inner side of bellows 11 to reduce friction. Short fastener 20 attaches flap end 18 to a medium-length piece of hook-and-loop fastener 27 positioned at the top of bellows 11.

FIG. 4C shows how strap 12 is diagonally worn over a shoulder and hip of a person 28. Containers 10 are rotated about pivots 25 (FIG. 4B) such that the containers are horizontal, which prevents their contents from accidentally spilling out, and to provide easy access to their contents.

Description

Figure 5B:
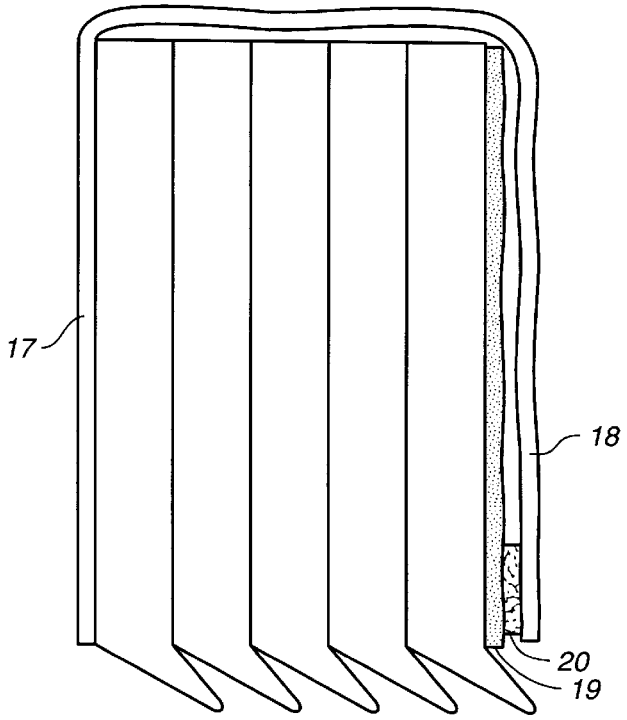
FIG. 5B is a side view of the container of FIG. 5A, after being collapsed.
Figure 5C:
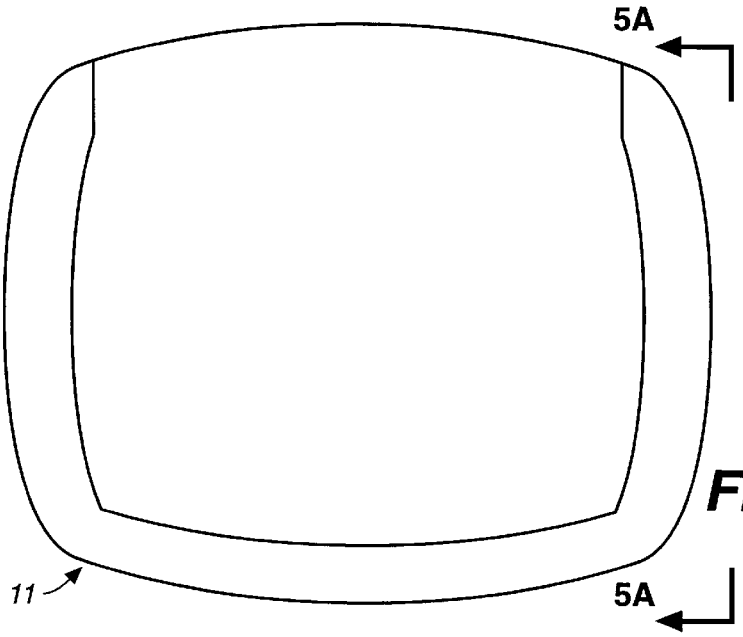
FIG. 5C is a view of one bellows or pleat section.
Figure 5A:
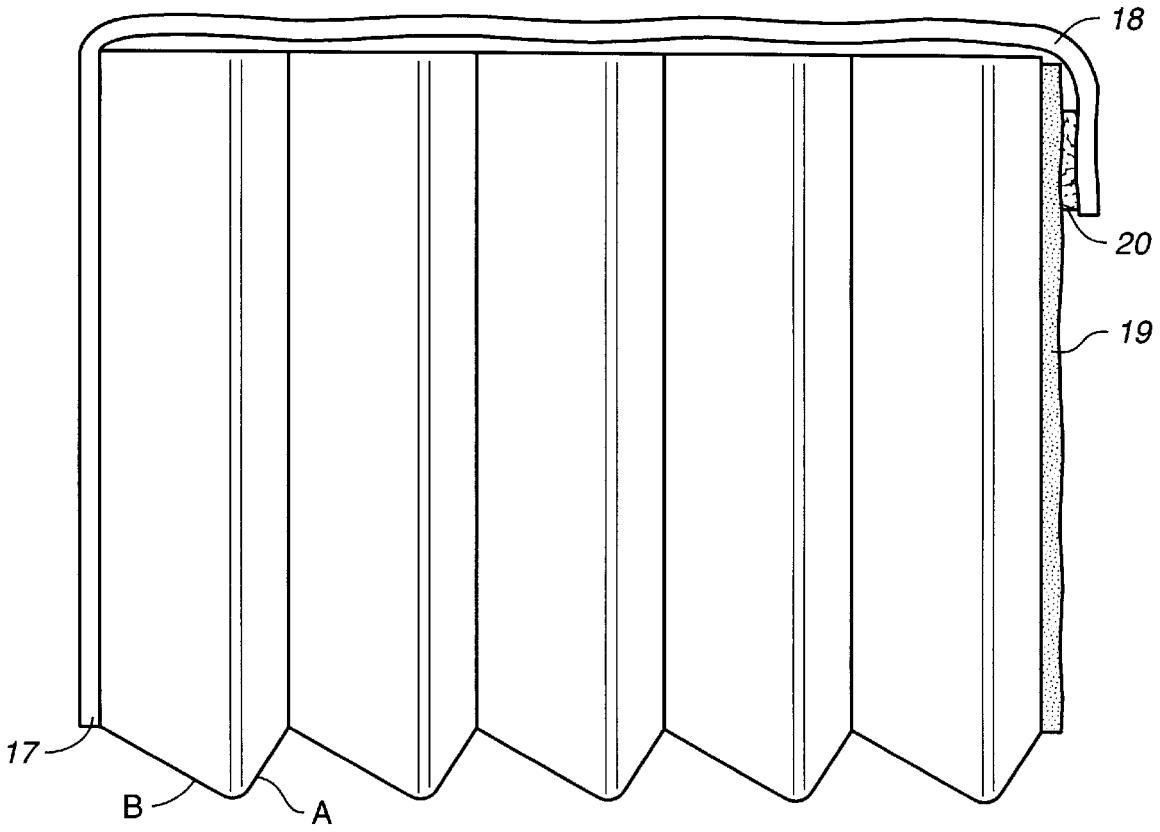
FIG. 5A is a side view of the container, after expansion.

FIGS. 5A, 5B, and 5C

Bistable Pleats

As shown in the side view of FIG. 5A, bellows 11 is blow molded and consists of a number of pleats. Each pleat comprises a short section or panel A and a long section or panel B, similar to that in U.S. Pat. No. 4,492,313 to Touzani (1985). The container is shown fully expanded. As shown in FIG. 5C, the sides-of the bellows are attached to the bottom by slightly rounded corners. This, together with the differing lengths of panels A and B, causes each pleated section of bellows 11 to be bistable as in Touzani's container, i.e., it will stay fully expanded or fully collapsed, but will not have a stable position in between these extremes.

When a pleat section is fully open (FIG. 5A) and then squeezed to a partially collapsed or centered position (halfway between FIGS. 5A and FIG. 5B), the rounded corners of side A will be stressed in a state of compression. This will cause this intermediate position to be unstable, so that side A will tend to snap over and beyond this position to an overcentered or collapsed position (FIG. 5B), as discussed in Touzani. Thus each or all pleats will have a stable collapsed or dosed position, so that the container will remain in a compact position when empty.

When any pleat of bellows 11 is expanded until side A is overcentered away from its respective side B, side A will tend to snap back, i.e., over and beyond this position to an overcentered or expanded position (FIG. 5A). The pleat or pleats will fully expand and stay in this position, as shown in FIG. 5A, to the maximum possible size. Thus each pleat of bellows 11 will stay fully expanded, even when container 10 is not completely full or empty. As a result, both hands of the user will be free to access the contents of the container without having to hold the container open manually with one or both hands.

Description

Figure 6A:
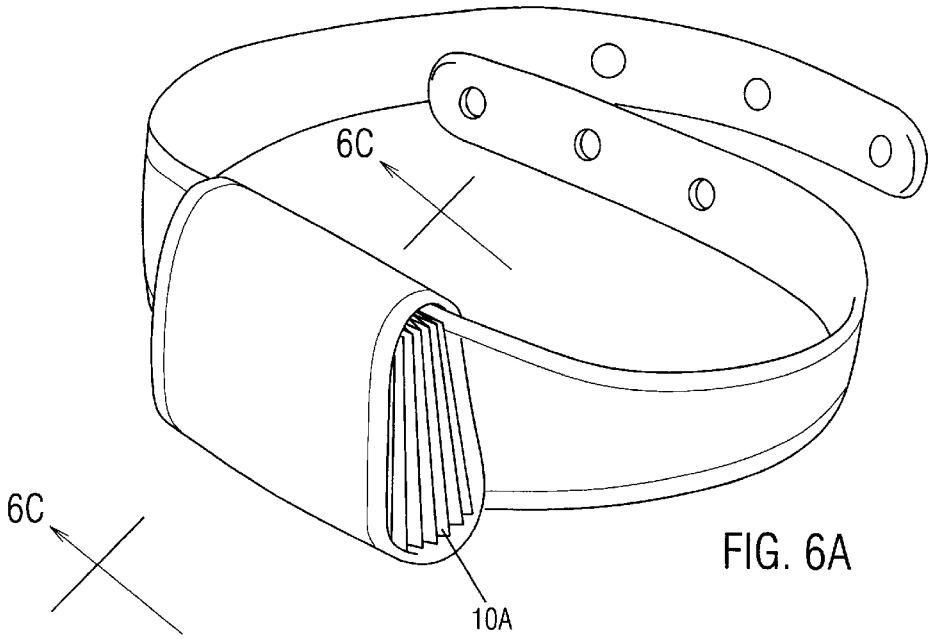
FIG. 6A is a perspective view of an embodiment where the container is detachable from a carrying belt, where a closure flap for the container is attached to the belt.
Figure 6B:
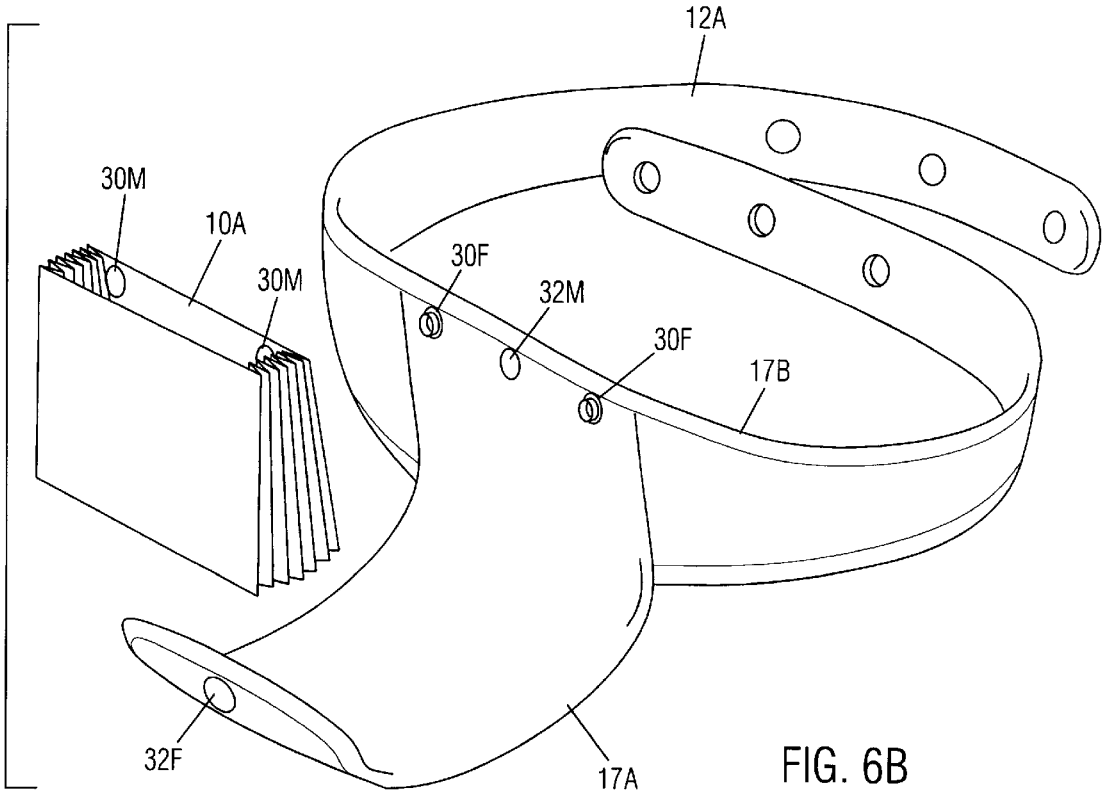
FIG. 6B is an exploded view of the embodiment of FIG. 6A with the container removed from the belt.
Figure 6C:
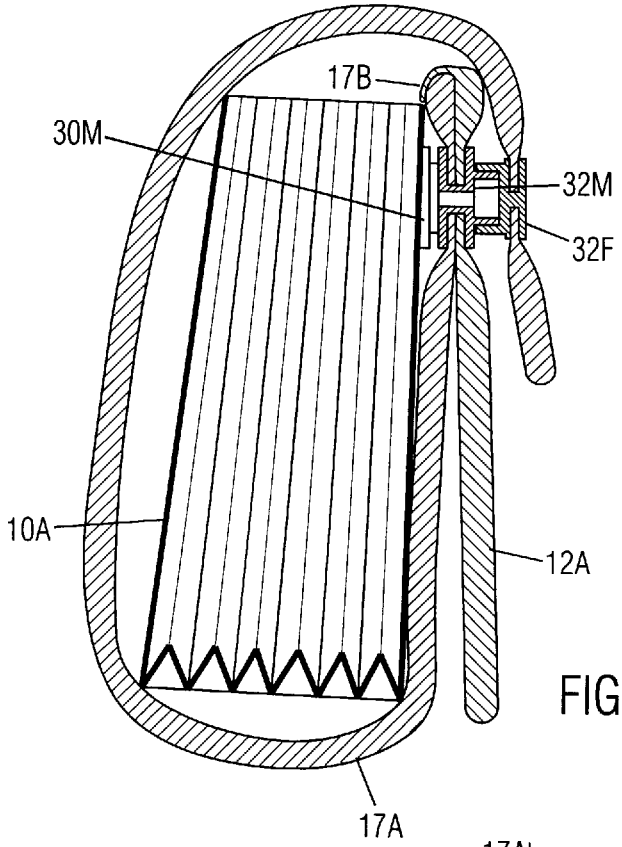
FIG. 6C is a cross-sectional view of the container of FIG. 6A, taken along line 6C—6C of FIG. 6A.

FIGS. 6A, 6B, and 6C

Removable Container

In FIGS. 6A to 6C, the container is removable from the belt so that it can be more conveniently accessed, put on a table or other support, etc.

As shown in FIG. 6B, belt 12A has a flap 17A attached thereto, e.g., by sewing or adhesive. The upper, inner, or proximal end of belt 17A is attached to the upper end of the midpoint of belt 12A, preferably by sewing so that the upper edge of the flap is under the top seam 17B of the belt. A pair of snap fastener female halves 30F are attached to the flap near its opposite sides and to the belt, near the point of attachment of the flap to the belt. The flap is long enough to extend completely around container 10A and the distal or remote end of the flap has a snap fastener female half 32F attached thereto and centered thereon. A snap fastener male half 32M is attached to the flap and belt, at the midpoint between female halves 30F. Container 10A has plain, rigid front or distal and rear, back, or proximal sides. The inner or back side of container 10A has a pair of snap fastener male halves 30M attached thereto, in positions corresponding to female halves 30F. Otherwise container 10A is identical to the containers of the previous figures; it uses the bistable bellows with curved bottom corners.

Operation

FIGS. 6A, 6B, and 6C

In operation, container 10A is snap fastened to the belt-flap assembly using snap pairs 30M–30F and flap 17A is bent completely around container 10A and attached to the inner side of the belt using snap fastener halves 32M and 32F, as shown in FIG. 6A. Thus the flap and the snaps hold the container to the belt. One or more cards (not shown) are placed within the container and the container is opened or collapsed or expanded as necessary to accommodate the quantity of cards placed within the container. The belt is worn by a card trader.

If the trader desires to access the inside of the container to remove or add one or more cards, the trader unsnaps snap half 32M and opens flap 17A outwardly. It will stay opened due to its weight so that the trader does not have to use a hand to hold the flap open. The trader can open the container further and remove or add cards, as desired.

If the trader desires better access to the inside of the container, e.g., when seated at a table for extended card trading negotiations, the trader can easily remove the container from the belt and flap by unsnapping snaps 30 from the belt-flap assembly, thereby releasing the container, as shown in FIG. 6B. The container can now be handled easily on its own, placed upon a table, and opened and dosed more readily.

Description

FIGS. 6A, 6B, and 6C

Removable Container And Flap

Figure 7:
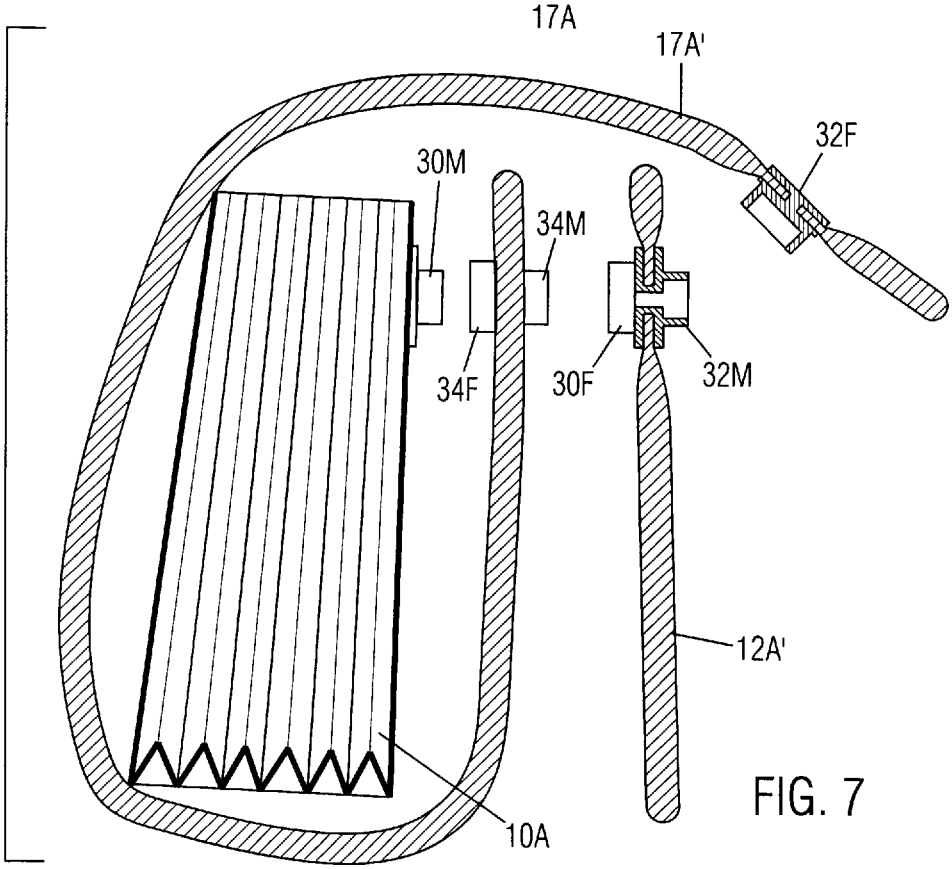
FIG. 7 is a cross-sectional view similar to FIG. 6C, but where the flap as well as the container, is detachable from the belt.

In addition to providing a removable container, the flap itself can be made removable from the belt, as shown in the sectional view of FIG. 7. Here belt 12A' is identical to belt 12A of FIG. 6, except that no flap is attached thereto. The two snap fastener female halves 30F (only one of which is shown in full side view) are attached only to the belt in the same positions as in FIG. 6B. Male snap half 32M (shown in section).is also attached only to the belt. The container is the same as that of FIG. 6, except that it has a center male snap (not shown) to mate with female snap half 32F of the flap.

Instead of being sewn to the belt, flap 17A' has snaps so that it can be removed and reattached easily from the belt and the container. To this end it has two snaps 34F/M in the same positions as female halves 30F. Each snap 34F/M has a male side 34M facing the belt and a female side 34F facing the container. Thus the two male halves can be snapped onto respective female halves 30F of the belt and the two male halves on the opposite side can be snapped onto male halves 30M of the container. The container can thus be removed, leaving a flap-belt assembly, or the flap-container assembly can be removed from the belt.

The container-flap assembly is removed when the trader wishes to have a closure flap for the container to prevent spillage of cards, e.g., when the container might be shipped or handled by several persons. Snap half 32F at the distal end of the flap can be secured to the male snap half at the center of the container. When no cover is needed for the container, e.g., if just the trader is handling it for a short time, the flap can be left snapped to the belt.

The snaps can all be replaced by other types of fasteners, such as hook-and loop fasteners.

Conclusion, Ramifications, and Scope

Accordingly the reader will see that I have provided an improved expandable and collapsible belt-strap container. It may be expanded and collapsed to suit and protect the volume of its contents. It can maintain any desired volume, even when empty. It has a flap which can be tightly dosed, regardless of the volume of the container, and which automatically stays open for better access to the interior of the container. It may be conveniently and effortlessly carried on a person. It may be leveled whether the strap is worn on the waist or the shoulder. It has a snap-closing flap which automatically stays opened or closed without springs, and it is simple and economical to produce. It may be expanded or collapsed, and due to its bistable bellows panels with rounded corners, it will retain itself in fully expanded or fully collapsed condition, or any condition in between. It can be tilted out from the strap or belt for easy access to its contents by virtue of its elastic attachment portions. The user can access all of the cards in an easy manner with both hands. The user can remove just the container from the belt, or the container with a covering flap.

While the above description contains many specificities, it should not be considered to limit the scope of the invention, but only to provide examples of the preferred embodiments. Many other ramifications and variations are possible within the teachings of the invention. For example, the components may be made of different materials. Flap end 18 may be attached to the inner side of container 10. Other buckling means for strap 12 may be used, and other pivoting means for container 10 may be used. The bellows may have pleats with equally sized sections and square bottom corners, so that the pleats will not be bistable, in this case the contents will hold the bellows expanded. In FIG. 6, the flap may be attached to the vertical middle of the belt or strap and the container may be attached directly to the belt or strap. In addition to carrying collector's sports cards, the container can also carry post cards, tickets, coupons, autographs, etc.

Thus the scope of the invention should be determined by the appended claims and their legal equivalents, and not by the examples given.

We claim:

1. A container assembly which can be carried by a belt or strap on a person's body and which will remain accessible if opened, comprising:

a belt comprising an elongated, flexible member having outside and inside surfaces and a pair opposite ends, said belt being long enough to extend around a torso of a person's body, said opposite ends of said belt containing coupling means for coupling said opposite ends together, a flap having proximal and distal ends, said proximal end being attached to said belt, a bellows compartment having an outer wall, an inner wall having outside and inside surfaces, opposite sides, a bottom, and a top opening, said opposite sides and said bottom connecting said outer wall to said inner wall and comprising a plurality of expandable pleats so that said bellows compartment can be collapsed to a state where said outer wall is relatively close to said inner wall, so that said top opening is shut, or expanded to a state where said outer side is relatively far from said inner side, so that said top opening is open, fastening means on said outside surface of said belt and said outside surface of said inner wall of said bellows compartment for removably fastening said belt to said bellows compartment, said flap being long enough so that when said bellows compartment is attached to said belt, said flap can extend from said belt, under said bottom of said bellows compartment, up adjacent said outer wall of said bellows compartment, over said top opening of said bellows compartment, and down adjacent said belt, and connecting means on said distal end of said flap and said belt for removably connecting said distal end of said flap to said belt.

2. The container assembly of claim 1 wherein said proximal end of said flap is permanently attached to said belt.

3. The container assembly of claim 2 wherein said fastening means on said outside surface of said belt and said outside surface of said inner wall of said bellows compartment for removably fastening said bellows compartment to said belt comprises mating hook-and-loop fasteners.

4. The container assembly of claim 1 wherein said proximal end of said flap and said belt contain affixing means for removably affixing said proximal end of said flap to said belt.

5. The container assembly of claim 4 wherein said affixing means comprises a snap fastener.

6. A container which can be carried on a person, comprising:

a bellows compartment having an outer wall, an inner wall, a pair of opposite sides connecting said outer and inner walls, a bottom connecting said outer and inner walls, and an open top extending between said outer and inner walls, said opposite sides and said bottom comprising a plurality of pleats for allowing said bellows compartment to be expanded and collapsed, a belt attached to said inner wall of said bellows compartment, and a cover comprising an elongated flexible flap having a proximal end and a distal end, said proximal end of said flap being hingeably attached to said inner wall of said bellows compartment, said flap extending from said inner wall, under said bottom of said bellows compartment, up adjacent said outer wall of said bellows compartment, and over said top opening of said bellows compartment, to said inner wall of said bellows compartment, such that when said distal end of said flap is pivoted outwardly to an opened positioned extending away from said inner and said outer walls of said bellows compartment, the weight of said flap will cause said flap to remain in said opened position, said distal end of said flap containing fastening means for removably fastening said distal end of said flap to said inner wall of said bellows compartment, whereby said container can be opened with one hand and will remain open so that said person can access a large number of cards on the inside of said container with both hands after opening said flap.

7. The container of claim 6 wherein each of said pleats of said bellows compartment comprises a long section and a short section, each pleat of each of said pair of sides of said bellows compartment being joined to a respective pleat on said bottom of said bellows compartment by a rounded pleated comer such that each pleat will be bistable and said bellows compartment will remain stably in any position from collapsed to expanded on its own.

8. The container of claim 6, wherein said fastening means for fastening said distal end of said flap to said inner side of said bellows compartment comprises a first fastening portion attached to said inner wall of said bellows compartment, and a second fastening portion attached generally to said one side of said distal end of said flap, said first fastening portion being substantially larger than said second fastening portion, such that said second fastening portion may be fastened to any position on said first fastening portion.

9. The container of claim 8 wherein said fastening means comprises a hook-and-loop fastener.

10. The container of claim 6, further including a plurality of elastic portions on said belt, such that when said container is strapped to said person by said belt, said elastic portions will allow said inner wall of said bellows compartment to be pivoted away from said person.

11. A container, comprising:

a bellows compartment having an outer wall, an inner wall, a pair of opposite sides connecting said outer and inner walls, a bottom connecting said outer and inner walls, and an open top extending between said outer and inner walls, said opposite sides and said bottom comprising a plurality of pleats for allowing said bellows compartment to be expanded and collapsed, said pair of opposite sides and said bottom being straight in a direction parallel to said outer and said inner walls, each side and said bottom comprising a plurality of pleats, each section of each pleat being generally straight in said direction parallel to said outer and said inner walls, each of said pleats comprising a long section and a short section, each pleat of each of said pair of sides of said compartment being joined to a respective pleat on said bottom of said compartment by a rounded corner, such that each pleat will be bistable so that it will remain stably expanded or stably collapsed and said compartment will remain stable in any of a multitude of positions, from collapsed, where said outer wall is close to said inner wall, to expanded, where said outer wall is separated from said inner wall, a cover comprising an elongated, flexible flap having a proximal end and a distal end, said proximal end of said flap being attached to said outer side of said bellows compartment, a portion of said flap between said distal end and said proximal end extending across said top opening of said bellows compartment to over said inner side of said bellows compartment, such that when said distal end of said flap is pivoted outwardly to an opened position adjacent said outer side of said compartment, the weight of said flap will cause said flap to remain in said opened position, and fastening means for fastening said distal end of said flap to said inner side of said bellows, said fastening means comprising a first fastening portion attached to said inner side of said bellows, and a second fastening portion attached generally to one side of said distal end of said cover, said first fastening portion being substantially larger than said second fastening portion, such that said second fastening portion may be fastened to any position on said first fastening portion.

12. The container of claim 11 wherein said fastening means comprises a hook-and-loop fastener.

13. A container which can be carried on a torso of a person, comprising:

a strap which can be extended around said torso of said person, said strap having a front surface and a back surface, and a bellows compartment having an outer wall, an inner wall, a pair of opposite walls connecting said outer and inner walls, a bottom connecting said outer and inner walls, and a top opening extending between said outer and inner walls, said pair of opposite sides comprising a plurality of expandable pleats so that said bellows compartment can be compressed to a collapsed state where said outer wall is relatively close to said inner wall or extended to an expanded state where said outer wall is relatively far from said inner wall, and pivot means pivotably attaching said inner wall of said bellows compartment to said strap, said pivot means enabling said bellows compartment to pivot with respect to said strap about an axis generally normal to said front surface of said strap and said inner wall of said bellows, said pivot means enabling said bellows compartment to be pivoted to a horizontal position independent of any orientation of said strap on said torso of said person.

14. An expandable and collapsible container, comprising:

a compartment having an outer wall, an inner wall, a pair of opposite sides connecting said outer and inner walls, a bottom connecting said outer and inner walls, and an open top extending between said outer and inner walls, said opposite sides and said bottom of said compartment being straight in a direction parallel to said outer and said inner walls and comprising a plurality of pleats for allowing said compartment to be expanded and collapsed by separating said outer and said inner walls or pushing said outer and said inner walls together, each of said pleats comprising a long section and a short section, each section of each pleat being generally straight in said direction parallel to said outer and said inner walls, each pleat on each of said pair of sides of said compartment being joined to a respective pleat on said bottom of said compartment by a rounded pleated corner such that each pleat will be bistable so that it will remain stably expanded or stably collapsed so that said compartment will remain stable in any of a multitude of positions, from collapsed, where said outer wall is close to said inner wall, to expanded, where said outer wall is separated from said inner wall.

15. The container of claim 14, further comprising a cover for covering said open top of said compartment, said cover comprising an elongated flap having distal and proximal ends, said proximal end attached to a wall of said compartment and being sized to extend over said open top and adjacent said inner wall of said compartment, such that when said distal end of said flap is pivoted outwardly to an opened position adjacent said outer wall of said compartment, the weight of said flap will cause said flap to remain in said opened position.

16. A container which can be carried on one's person, comprising:

a bellows compartment having an outer wall, an inner wall, a pair of opposite sides connecting said outer and inner walls, a bottom connecting said outer and inner walls, and an open top opening extending between said outer and inner walls, said pair of opposite sides comprising a plurality of expandable pleats so that said compartment can be compressed to a collapsed state where said outer wall is relatively close to said inner wall or extended to an expanded state where said outer wall is relatively far from said inner wall, a belt having outer and inner sides, said belt being arranged to extend around the torso of said person with said inner side adjacent said person's torso, said inner wall of said compartment being attached to said outside side of said belt, a cover comprising an elongated, flexible flap having a proximal end and a distal end, said proximal end of said flap being attached to said bellows compartment, a portion of said flap between said distal end and said proximal end extending over said top opening of said compartment to cover said top opening and down adjacent said inner side of said belt, such that when said distal end of said flap is pivoted outwardly to an opened position extending away from said inner and said outer walls of said compartment, the weight of said flap will cause said flap to remain in said opened position, said distal end of said flap containing fastening means for removably fastening said distal end of said flap to said inner side of said belt, said belt comprising elastic means for allowing said belt to be pivoted away from said person to enable said person to access said inner side of said belt so as to be able to fasten and unfasten said distal end of said flap from said inner side of said belt, whereby said container can be opened with one hand so that said person can access a large number of cards on the inside of said container with both hands after opening said cover.

* * * * *

UNITED STATES PATENT AND TRADEMARK OFFICE

CERTIFICATE OF CORRECTION

PATENT NO. : 5,862,526
DATED : Jan 26, 1999
INVENTOR(S) : K. LONGCOR ET AL.

It is certified that error appears in the above-identified patent and that said Letters Patent is hereby corrected as shown below:

Col. 2, line 4, change "dosed" to —closed— .

Signed and Sealed this

Twenty-fifth Day of May, 1999

*Attest:*

Q. TODD DICKINSON

*Attesting Officer*

*Acting Commissioner of Patents and Trademarks*